United States Patent [19]

Van Loon, III

[11] Patent Number: 5,050,999

[45] Date of Patent: Sep. 24, 1991

[54] OPEN-MESH NET BAG AND METHOD OF FORMING THE SAME

[76] Inventor: James C. Van Loon, III, E. Hill Rd., Box 480 R.R. #1, Jefferson, N.Y. 12748

[21] Appl. No.: 558,780

[22] Filed: Jul. 26, 1990

[51] Int. Cl.[5] ..... B65D 30/06; B65D 33/12; B65D 33/28

[52] U.S. Cl. ..... 383/76; 383/6; 383/74; 383/117; 493/225; 493/239; 493/928

[58] Field of Search ..... 383/6, 72, 74, 76, 117; 493/239, 223, 224, 225, 925, 928

[56] References Cited

U.S. PATENT DOCUMENTS

| | | | |
|---|---|---|---|
| 403,928 | 5/1889 | Emeric | 383/117 X |
| 2,447,940 | 8/1948 | Holland | 383/76 X |
| 2,563,616 | 8/1951 | Perino | 383/6 X |
| 3,746,066 | 7/1973 | McIntyre | 383/6 X |
| 4,156,446 | 5/1979 | Nathan | 383/76 X |

FOREIGN PATENT DOCUMENTS

| | | | |
|---|---|---|---|
| 982701 | 6/1951 | France | 383/117 |
| 91438 | 11/1921 | Switzerland | 383/6 |

*Primary Examiner*—Stephen Marcus
*Assistant Examiner*—Jes F. Pascua
*Attorney, Agent, or Firm*—Steinberg & Raskin

[57] ABSTRACT

An open-mesh net bag is formed of a rectangular piece of open-mesh netting and a pair of elongated flexible cords. A central length portion of each cord is interlaced through the meshes of netting piece along a respective end edge region, a pair of loop-forming length portions are intertwined with each other to form a loop with the central length portion, a pair of intermediate length portions are interlaced through the meshes along about one-half the length of the side edge regions, whereupon terminal end portions of the respective cords are connected to each other. A method of forming the open-mesh bag is also disclosed.

26 Claims, 4 Drawing Sheets

FIG. 2
PRIOR ART
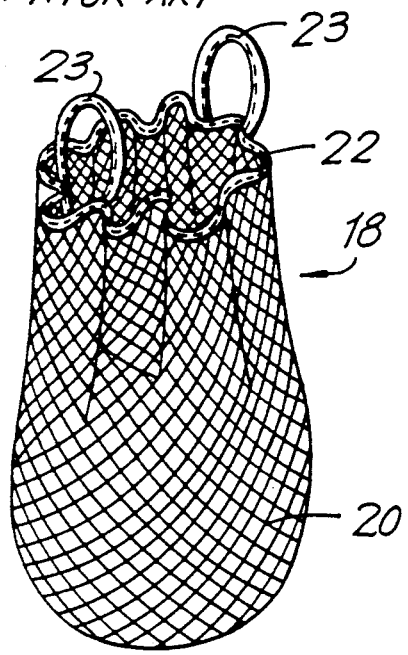
FIG. 1
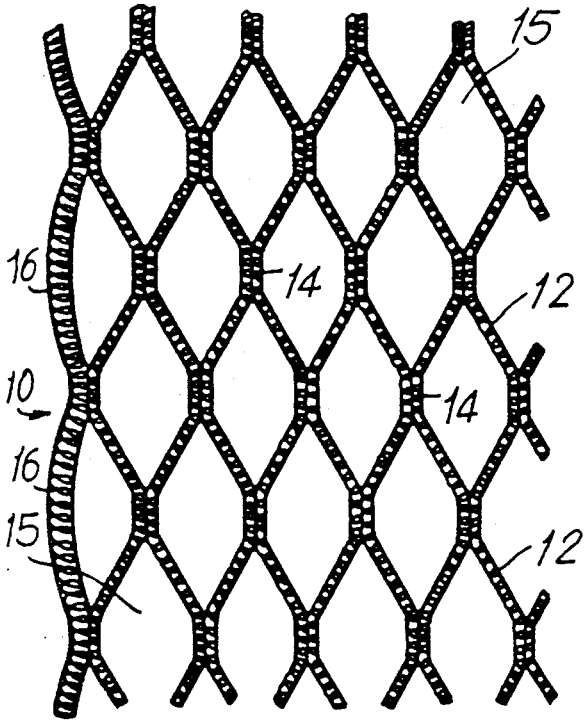
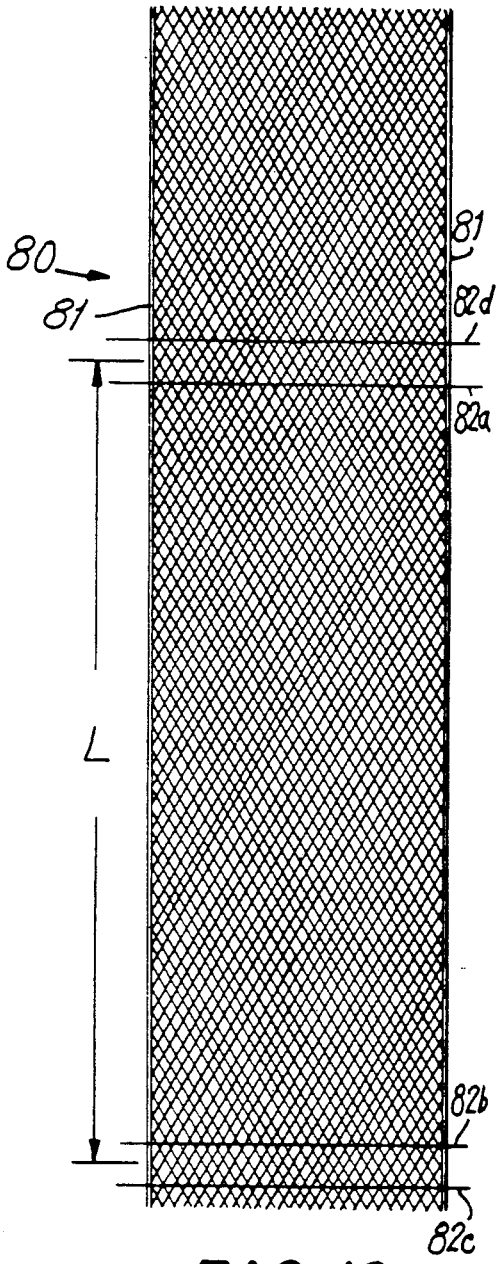
FIG. 10

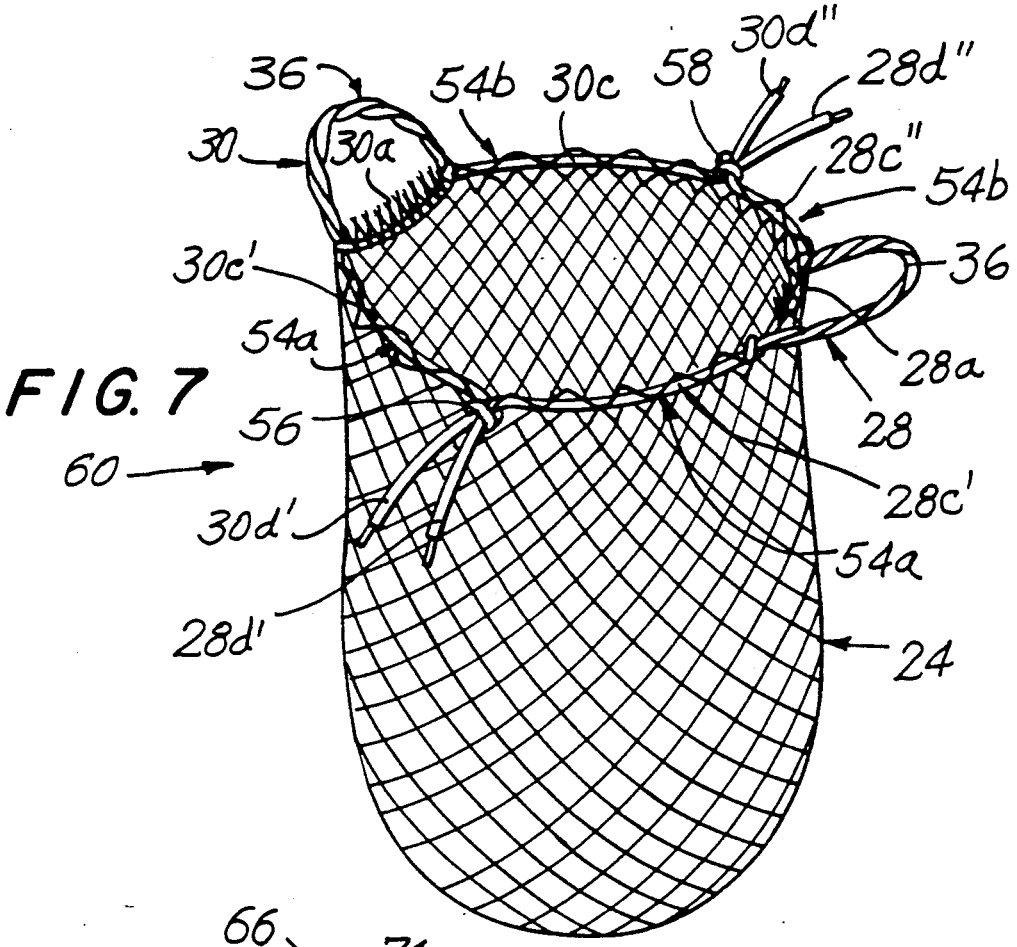
FIG. 7
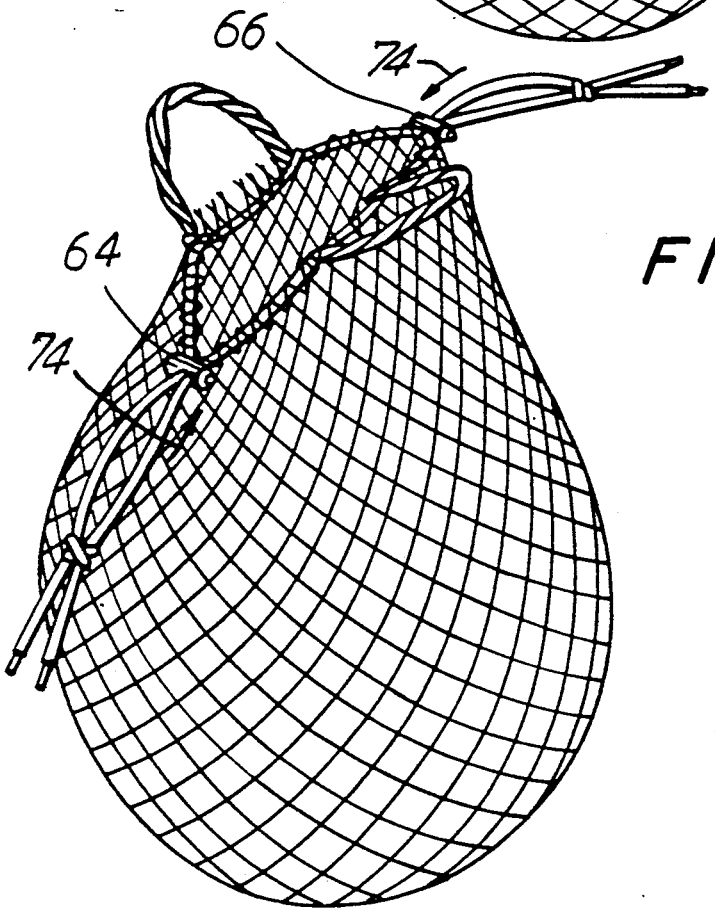
FIG. 8
FIG. 9
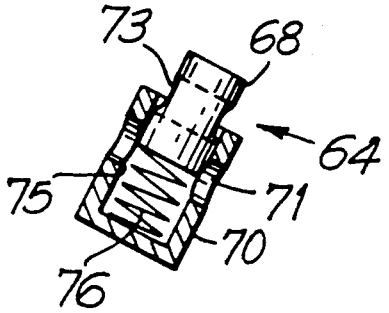

OPEN-MESH NET BAG AND METHOD OF FORMING THE SAME

BACKGROUND OF THE INVENTION

This invention relates generally to bag construction and, more particularly, to the construction of open-mesh net bags.

As the deleterious effects on the environment of the disposal of bags made of non-biodegradable material, such as plastic "poly" bags for carrying groceries, produce and other items, become more apparent, a need has arisen for a viable alternative, e.g. a bag construction which can be reused thereby avoiding environmental problems, yet which is convenient in use, simple in construction, and low in cost.

The benefits of bags made of open-mesh net material are well recognized. Such bags are relatively strong and durable so as to be reusable over extended periods of time. They are lightweight and can be compacted into a very small volume when empty, unlike other types of bags which are large and cumbersome and therefore inconvenient to carry when empty. While conventional bags are generally limited to the capacity which they provide, bags formed of open-mesh net material conform to the shape of the articles which they carry and are therefore flexible in the carrying capacity or volume which they provide. Therefore, conventional open-mesh net bags are reusable and quite convenient.

On the other hand, conventional open-mesh net bags are relatively complicated in construction and, consequently, expensive. For example, one popular method of construction utilizes a rectangular piece of open-mesh fabric cut from a continuous web. The bag is formed by folding the net fabric piece over itself and stitching the side and bottom margins to each other to form side and bottom seams. A drawcord may then be interlaced through the fabric mesh around the mouth of the bag. Alternatively, a top rim may be crocheted into, or bias tape sewn onto, the net fabric around the mouth of the bag in any conventional manner and carrying handles then sewn thereto. In any event, conventional open-mesh net bags are costly to produce and therefore are not effective alternatives to conventional shopping bag constructions.

SUMMARY OF THE INVENTION

Accordingly, it is a main object of the present invention to provide a new and improved open-mesh net bag construction and method of forming the same.

Another object of the present invention is to provide a new and improved open-mesh net bag construction which not only is convenient in use, but which is simple in construction and low in cost.

Still another object of the present invention is to provide a new and improved open-mesh net bag and a method for forming the same in which the bag is formed from a substantially rectangular piece of open-mesh net fabric and in a manner which requires no stitching, thereby rendering the bag simple in manufacture and low in cost.

A further object of the invention is to provide a new and improved method of forming an open-mesh net bag in which rectangular pieces of open-mesh fabric material are obtained by cutting from a strip of such material unwound from a roll, and wherein manufacturing steps may be efficiently accomplished prior to cutting the strips to maximize efficiency in manufacture.

Briefly, in accordance with the present invention, these and other objects are attained by providing an open-mesh bag and method for forming the same comprising a substantially rectangular piece of open-mesh netting and a pair of cords which are interlaced through the meshes of the netting piece in a certain manner and which are then connected to each other to form a completed open-mesh net bag having a pair of carrying handles and, according to one embodiment of the invention, a drawstring construction for closing the mouth of the bag.

In particular, at each of the two end edge regions of the rectangular piece of netting, a cord is interlaced through the meshes whereupon a pair of handle-forming loops are formed by intertwining the cord with itself. Portions of the cord are then interlaced through the meshes of the netting piece along about one-half of the respective adjacent side edge regions of the netting piece whereupon the ends of the two cords are connected to each other to complete the construction of the bag. The net bag so constructed requires no stitching and is formed from a simple rectangular piece of netting so that it is relatively simple in construction and low in cost.

DESCRIPTION OF THE DRAWINGS

A more complete appreciation of the present invention and many of the attendant advantages thereof will be readily understood by reference to the following detailed description when considered in connection with the accompanying drawings in which:

FIG. 1 is an enlarged section of net material useful in forming a bag in accordance with the present invention;

FIG. 2 is a perspective view of one example of a conventional prior art open-mesh net bag provided with a pair of carrying handles;

FIG. 7 is a perspective view of an open-mesh net bag in accordance with the invention and formed by a method in accordance with the invention;

FIG. 8 is a view similar to FIG. 7 showing another embodiment of a bag in accordance with the invention in which a drawstring capability is provided for opening and closing the mouth of the bag;

FIG. 9 is an enlarged side view partially broken away of a cord locking device comprising a component of the embodiment of the bag illustrated in FIG. 8; and FIG. 10 is a fragmentary view of a strip of open-mesh fabric unwound from a roll through which a plurality of cords are interlaced for efficient manufacture of plurality of bags according to the invention.

DESCRIPTION OF THE PREFERRED EMBODIMENTS

Figure 3:
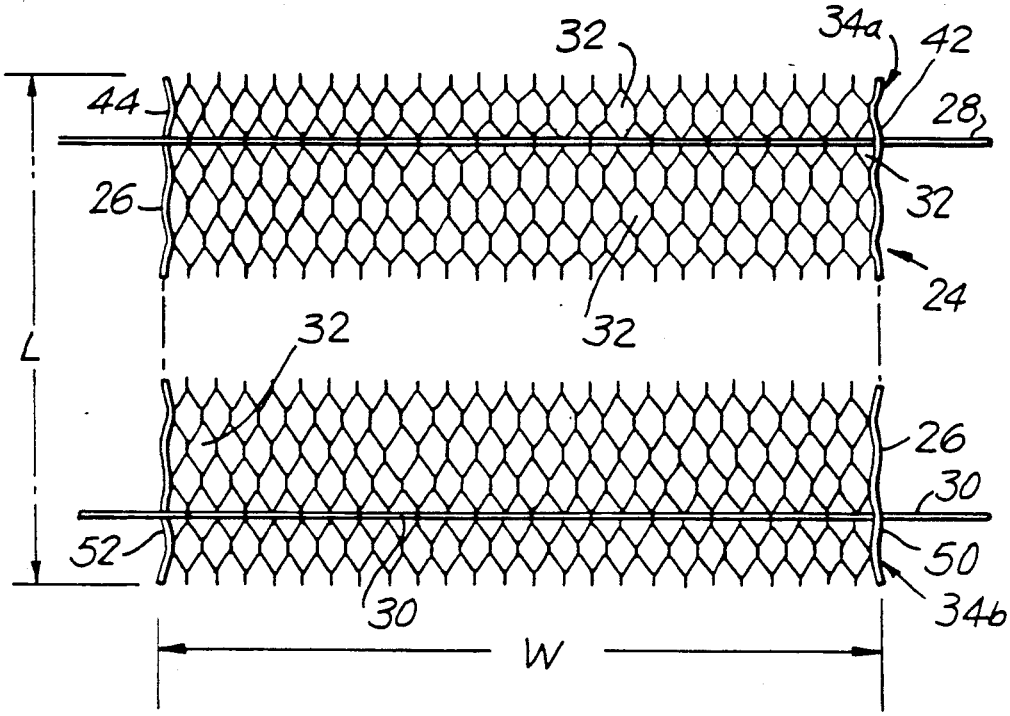
FIG. 3 is a plan view of a rectangular piece of open-mesh netting with the central region omitted for purposes of clarity, and showing a pair of cords interlaced through the meshes of the netting piece along the opposite end edge regions thereof in accordance with a forming method of the invention.

Referring now to the drawings wherein like reference characters designated identical or corresponding parts throughout the several views, and more particularly to FIG. 1, an enlarged section of open-mesh net material useful in forming open-mesh net bags is designated 10. The material comprises a fabric formed of a plurality of strands 12 which are knit and connected at intersections 14 in a conventional manner, such as on a Raschel knitting machine, to form a plurality of meshes 15. Selvage 16 extends along one or both of the side edges (only one shown in FIG. 1) of the net material. The strands of open-mesh net material may be constituted of either natural or synthetic fibers capable of being spun, twisted, or extruded into yarn that can be knit on a Raschel machine to produce a "knotless" netting. Although nylon is preferred due to its stretchability, the material may be formed from polyester, polypropylene, polyethylene, cotton, rayon, cellulose acetate, silk or other suitable material and blends thereof. It should also be understood that other types of open-mesh material may be used, such as woven fabric in which knots are formed at the intersection of the strands.

Referring now to FIG. 2, a conventional prior art bag formed of open-mesh net material of the type shown in FIG. 1, designated 18, is illustrated. Bag 18 is formed of a piece of open-mesh net material 20 having a bias tape rim 22 stitched around its edge to form the mouth of the bag. A pair of handles 23 are sewn to the rim 22. These finishing procedures are time consuming and costly and it is an object of the present invention to provide a new and improved open-mesh net bag which is functionally similar to the prior art bag shown in FIG. 2, but is simple in construction and inexpensive in manufacture.

Turning now to FIG. 3, a substantially rectangular piece of open-mesh netting 24 (the mid-region of which is not shown for purposes of clarity) is illustrated in which the initial steps of the method for forming the bag is also illustrated. The netting piece 24 is formed of ¾ inch square (unstretched) nylon mesh having a length L of about 52 inches, or about 36 meshes long in the machine direction, and a width W of about 36 inches, or about 24 meshes in the transverse direction. A double selvage 26 is provided along the side edges, i.e. the long sides of the netting piece 24, to provide extra strength and a more refined appearance to the finished product.

A pair of elongated flexible cords 28,30 (the end portions of which are not shown for purposes of clarity) are interlaced through the meshes 32 of the netting piece 24 along substantially the entire length of respective ones of the end edge regions 34*a*, 34*b*, of the rectangular netting piece. In the illustrated embodiment, each cord comprises a 52 inch length of 3/16th inch soft, braided nylon twine although it is understood that other lengths or materials may be utilized. It is noted that each cord 28, 30 is interlaced through the row of mesh 32 situated inwardly of the first or outer mesh row. This provides a measure of reliability in the case that one of the strands of a mesh through which cords 28, 30 pass, breaks.

Figure 4:
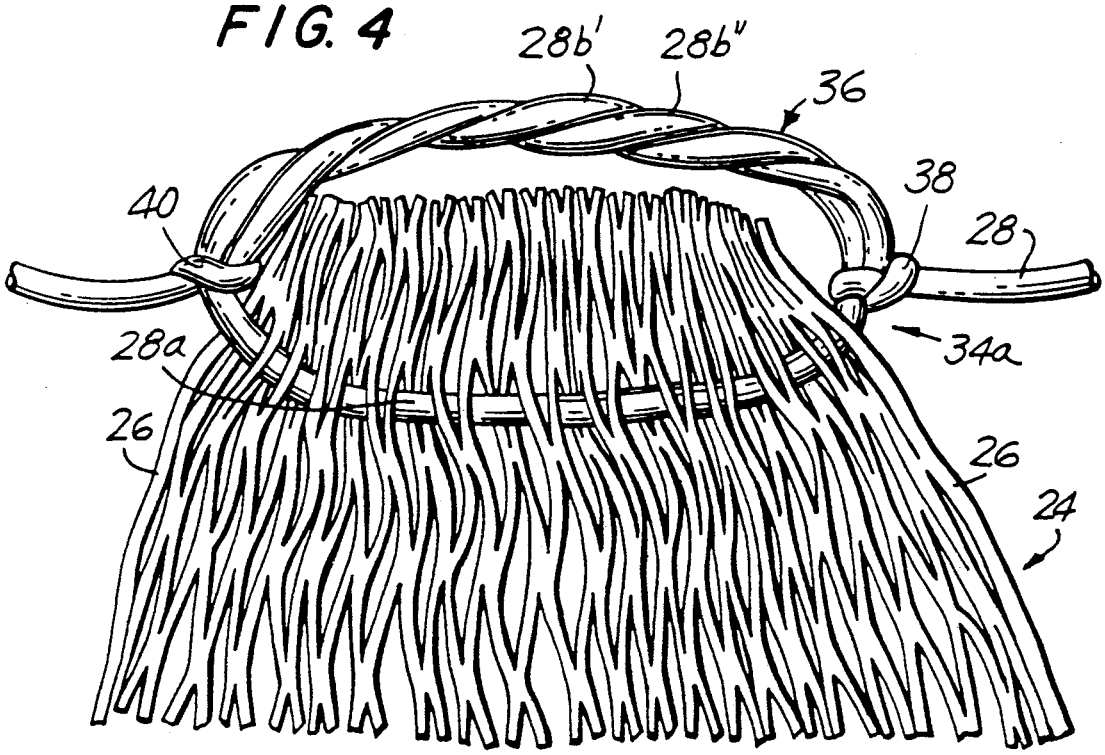
FIG. 4 is an enlarged fragmentary view showing a portion of an end region of the netting piece and the interlaced cord intertwined to form a loop in accordance with a forming method of the invention.

Referring now to FIG. 4, the first end edge 34*a* of netting piece 24 is gathered on a central length portion 28*a* of cord 28 and a pair of length portions 28*b*′ and 28*b*″ adjacent the central length portion 28*a* are then intertwined with each other and knotted at 38,40 to form a loop 36 along with the central length portion 28*a*. The loop 36 constitutes one of the handles for the bag being formed. The same procedure is performed with cord 30 at the opposite end edge region 34*b* of the netting piece 24.

Figure 5:
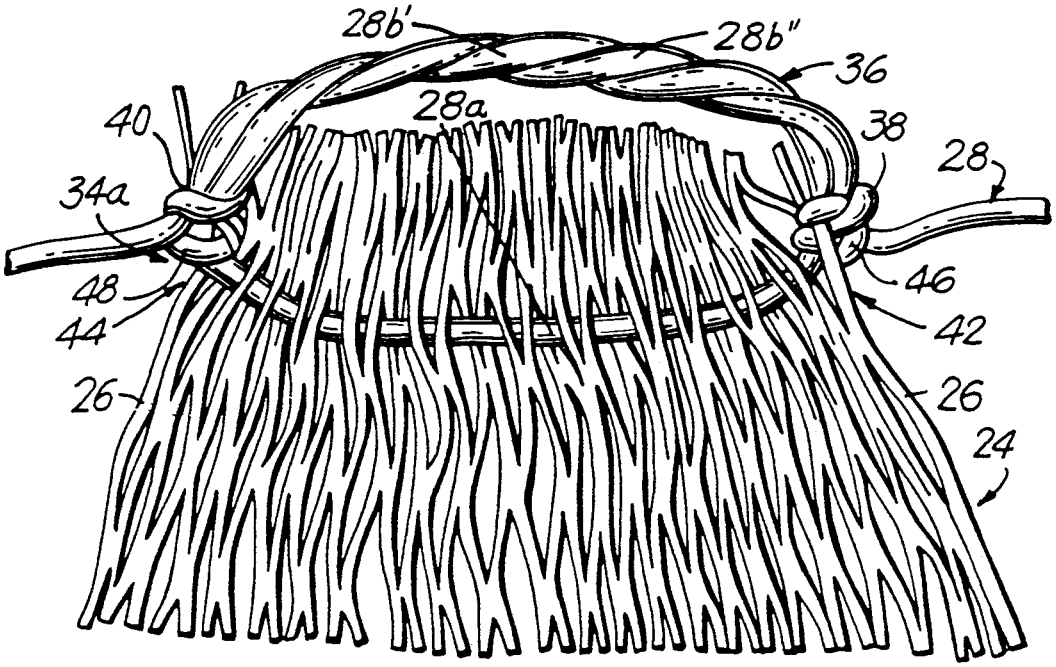
FIG. 5 is a view similar to FIG. 4 showing the cord attached to the corners of the netting piece after the loop-forming step of FIG. 4.

The cord 28 is then knotted (FIG. 5) to the corner regions 42 and 44 of the netting piece 24 at knots 46 and 48 to secure the ends of the loops 36 to the selvage 26. Similarly, the cord 30 is knotted to respective corner regions 50, 52 (FIG. 3) of the netting piece 24. This provides additional strength for the handles defined by the loops formed by the length portions of the respective cords 28 and 30.

Figure 6:
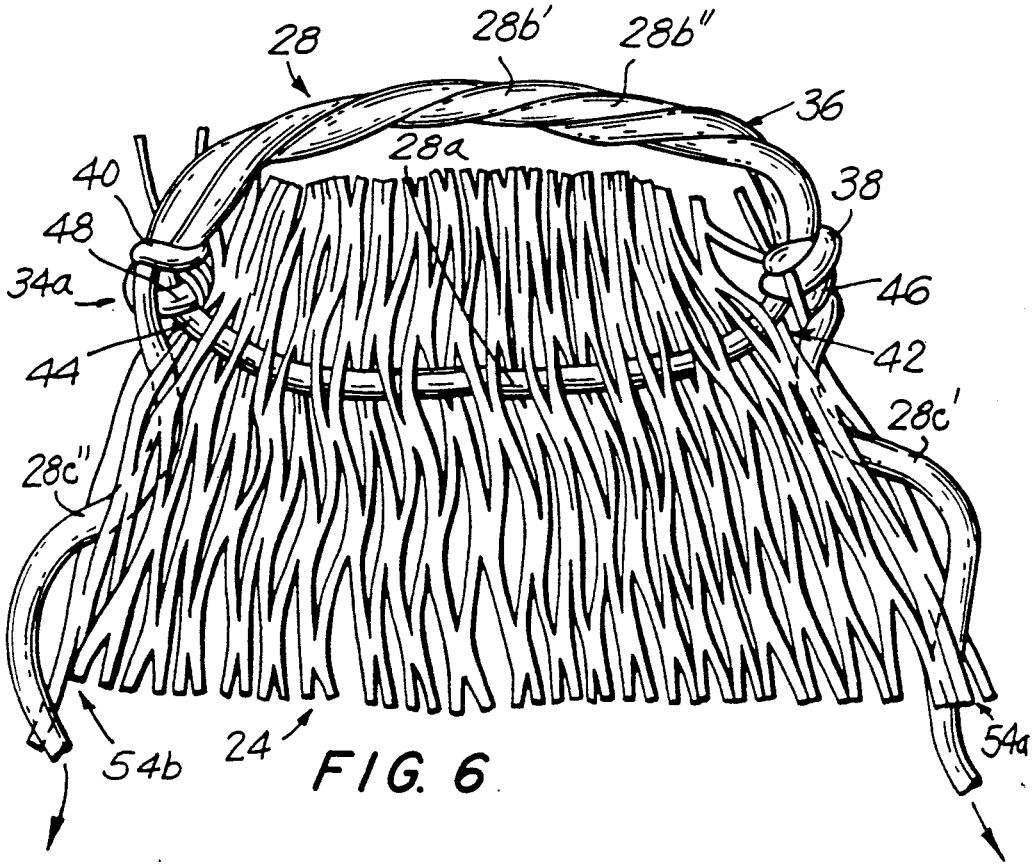
FIG. 6 is a view similar to FIGS. 4 and 5 showing the cord interlaced through the meshes of the netting piece from the corner regions along a part of the opposed side edge regions of the netting piece.

Turning now to FIGS. 6 and 7, a pair of intermediate length portions 28*c*′ and 28*c*″ of cord 28 are then interlaced through the meshes of the netting piece 24 from a respective corner region 42,44 along substantially half the length of a respective one of the side edge regions 54*a* and 54*b*. In the same manner, the intermediate length portions of cord 30 are interlaced through the meshes of the netting piece from respective corner regions 50,52 (FIG. 3) through substantially the other half of the lengths of the side edge regions 54*a* and 54*b* so that terminal end portions 28*d*′, and 28*d*″ of cord 28, and 30*d*′ and 30*d*″ (FIG. 7) of cords 28 and 30 are directed outwardly from the side edge regions 54*a*,54*b* at locations about midway along them.

In accordance with one embodiment of the invention, the terminal end portions 28*d*′ and 30*d*′ of cords 28 and 30 are connected to each other by a knot 56 substantially mid-way along the side edge region 54*a* of netting piece 24 while the terminal end portions 28*d*″ and 30*d*″ of cords 28 and 30 are knotted together at knot 58 substantially midway along the side edge region 54*b* of the netting piece to complete the construction of a bag 60 in accordance with the present invention.

Referring to FIGS. 8 and 9, instead of knotting the terminal end portions 28*d*′, 30*d*′; 28*d*″, 30*d*″ of cords 28 and 30 to each other as at 56,58 in FIG. 7, in another embodiment of a bag, according to the invention, designated 62, the pairs of the cord end portions are past through respective lock devices 64, 66. As best seen in FIG. 9, each lock device 64,66 comprises a body 70 having a cord aperture 71 formed therethrough and a locking member 68 having a cord aperture 73 formed therethrough. The locking member 68 is slidably positioned in a bore 75 of body 70 and is normally biased in an upper position by a spring 76 so that the cord apertures 71, 73 are off-set from each other. The locking members 68 of the lock devices 64,66 are depressed against the force of respective springs 76 to bring apertures 71, 73 into alignment to receive respective pairs of the cord terminal end portions. When the locking members are released, the end portions of the cord are clamped together under the force of spring 76.

Thus, according to this embodiment, the mouth 72 of bag 62 can be closed by sliding the locking devices 64,66 inwardly as shown by arrows 74. This shortens the length of the intermediate cord portions 28*c*′ and 30*c*′ causing the netting through which the cords pass to become gathered more closely together on the shortened cord intermediate portions thereby closing the bag mouth 62 in a drawstring fashion. To open the bag, it is only necessary to depress the locking members 68 of the lock devices 64, 66 and slide them outwardly on the cord terminal end portions 28*d*′, 30*d*′; 28*d*″, 30*d*″. The cord terminal end portions may be knotted outwardly of the lock devices to prevent them from being pulled from the cords.

The bag construction of the invention is particularly advantageous in that it permits the bags to be manufactured inexpensively in large quantities. For example, referring to FIG. 10, in manufacturing bags in accordance with the embodiments illustrated in FIGS. 3–8, a long strip of open-mesh net material 80 having a length of about 1,200 feet is initially unwound and cut from a roll (not shown). According to the illustrated embodiment, the strip is about 36 inches wide formed of ¾ inch square mesh material spanning about 24 meshes over its width. Selvage 81 is provided on the long edges of strip 80. A plurality of cords 82 are interlaced transversally across the width of the strip at spaced locations along the entire length thereof as shown in FIG. 10. For example, cords 82*a* and 82*b* constitute the cords which will form a single bag corresponding to cords 28 and 30 of the embodiment of FIGS. 3–8. Assuming the cords to be interlaced through a row of meshes spaced one row inwardly from the end edges of the rectangular piece of netting for purposes of reliability, the length L in FIG. 10 is about 52 inches and spans about 36 meshes. Cord 82*c* is interlaced through the mesh strip 80 at a row spaced about 3 mesh rows from cord 82*b* and constitutes the first cord of a next bag. Cord 82*d* constitutes the second cord of a preceeding bag. The strip 80 is then cut into rectangular pieces of open-mesh net between the second cord of a preceeding bag and the first cord of a next subsequent bag, e.g. between cords 82*d* and 82*a* and between cords 82*b* and 82*c*. The construction of the bags thus proceeds as described above. Alternatively, the strip can be cut transversely into rectangular pieces after the first handle of a following bag is interlaced and formed through the strip. About 225 to 250 bags can be made in this manner from a strip of this type.

The invention of course can vary from the particular embodiments illustrated. For example, the ratio of the length of the end edge regions to the length of the side edge regions of the netting piece is preferably greater than about 1 to 3, and most preferably is about 2 to 3. The mesh size of the netting piece is preferably greater than about ½ inch and although the selvage is shown as being provided on the side edge regions of the rectangular piece of netting, it is understood that this is not an absolute requirement. Any type of releasable locking means can be used to form a bag having a drawstring capability of the type shown in FIG. 8 so long as it permits connection of the terminal end portions of the pair of cords at a selectively variable position to correspondingly vary the lengths of the intermediate length portions of the cords, and thereby the size of the mouth of the bag. The cords used in the invention may comprise any type of flexible elongate member, such as twine, braid, tape, etc.

Obviously, numerous modifications and variations of the invention are possible in the light of the above teachings. It is therefore to be understood that within the scope of the claims appended hereto, the invention may be practiced otherwise than as specifically disclosed herein.

What is claimed is:

1. An open-mesh bag, comprising:

a substantially rectangular piece of open-mesh netting having a pair of opposed first edge regions, each first edge region extending between a respective pair of corner regions, and a pair of opposed second edge regions; and a pair of elongated flexible cords, each cord having a central length portion interlaced through the meshes of said netting piece along substantially the entire length of a respective one of said first edge regions thereof, a pair of loop-forming length portions intertwined with each other to form a loop along with said central length portion, a pair of intermediate length portions, each of which is interlaced through the meshes of said netting piece from a respective corner region thereof along substantially half the length of a respective one of said second edge regions, and a pair of terminal end portions, each of which is connected to a terminal end portion of the other flexible cord, said pairs of first and second edge regions of said netting piece forming a mouth of said bag and said loops constituting handles of said bag.

2. A bag as recited in claim 1 wherein said first edge regions of said netting piece are shorter than said second edge regions thereof.

3. A bag as recited in claim 2 wherein the ratio of the length of said first edge regions to the length of said second edge regions is greater than about 1 to 3.

4. A bag as recited in claim 3 wherein said ratio is about 2 to 3.

5. A bag as recited in claim 1 wherein the mesh size of said netting piece is greater than about ½ inch square.

6. A bag as recited in claim 5 wherein the mesh size of said netting piece is about ¾ inch square.

7. A bag as recited in claim 1 wherein said netting piece is cut from a strip withdrawn from a roll of open mesh net material.

8. A bag as recited in claim 7 wherein said second edge regions of said netting piece run in the longitudinal direction of said roll strip of open mesh net material.

9. A bag as recited in claim 8 wherein said second edge regions of said netting piece are provided with selvage.

10. A bag as recited in claim 1 wherein said one of said first and second edge region pairs is provided with selvage.

11. A bag as recited in claim 10 wherein said second edge regions of said netting piece are provided with selvage.

12. A bag as recited in claim 1 wherein each of said cords is affixed to said pair of corner regions of said netting piece between which said central region thereof extends.

13. A bag as recited in claim 1 wherein a terminal end portion of one of said cords is connected to a terminal end portion of the other of said cords by a knot.

14. A bag as recited in claim 1 further including cord locking means for connecting a terminal end portion of one of said cords to a terminal end portion of the other of said cords.

15. A bag as recited in claim 14 wherein said cord locking means comprises releasable locking means for connecting respective terminal end portions of said pair of cords at: a selectively variable position along said cords to correspondingly vary the lengths of said intermediate length portions of said cords and thereby the size of the mouth of said bag.

16. A bag as recited in claim 15 wherein said releasable locking means comprise a pair of lock devices, each having aperture means through which respective terminal end portions of said pair of cords slidably pass, and a locking member releasably spring biased into locking engagement with said cord terminal end portions.

17. A method for forming an open-mesh bag from a substantially rectangular piece of open-mesh netting having a pair of opposed first edge regions, each first edge region extending between a respective pair of corner regions, and a pair of opposed second edge regions, comprising the steps of:

at each of said first edge regions of said netting piece, interlacing a central portion of a respective elongated flexible cord through the meshes of said netting piece along substantially the entire length of said first edge region;

intertwining loop-forming length portions of each of said cords with each other to form a loop along with said central length portion thereof;

interlacing intermediate length portions of each of said cords through the meshes of said netting piece from a respective corner region thereof along substantially half the length of a respective one of said second edge regions; and connecting first ones of the terminal ends of each of said cords to each other at a point of connection; and connecting second ones of the terminal ends of each of said cords to each other at a second point of connection;

whereby said pairs of first and second edge regions of said netting piece form a mouth of said bag and said loops constitute handles of said bag.

18. A method as recited in claim 17 including the steps of:

providing said piece of open-mesh netting from a roll by unwinding a strip of open-mesh net material thereof, cutting the strip from the roll, and making a series of transverse cuts through said strip at locations spaced from each other to form a plurality of pieces of open-mesh material.

19. A method as recited in claim 18 wherein prior to making said transverse cuts, interlacing the central portions of a plurality of respective elongated cords through the meshes of said strip in the substantially transverse dimension of said strip at locations corresponding to first opposed edge regions of said plurality of pieces of open-mesh material thereafter cut from said strip.

20. A method as recited in claim 19 wherein said interlacing step is performed after said step of cutting said strip of open-mesh material from the roll.

21. A method as recited in claim 17 including the step of:

affixing each of said cords to said pair of corner regions between which said central region thereof extends.

22. A method as recited in claim 21 wherein said affixing step comprises knotting each of said cords to said pair of corner regions between which said central region extends at locations between said loop-forming and intermediate length portions thereof.

23. A method as recited in claim 17 wherein said first edge regions of said netting piece are shorter than said second edge region thereof.

24. A method as recited in claim 17 wherein said second edge regions of said netting piece are provided with selvage.

25. A method as recited in claim 17 wherein said step of connecting the terminal ends of each of said cords to each other comprises knotting said first and second ones of the terminal ends of each of said cords to each other.

26. A method as recited in claim 17 wherein said steps of connecting the terminal ends of each of said cords to each other comprises passing said first terminal ends of each of said cords through a first selectively locatable locking means, and passing said second terminal ends of each of said cords through a second selectively locatable locking means, and locking said locking means in a selected position.

* * * * *